US006908366B2

(12) United States Patent
Gagliardi

(10) Patent No.: US 6,908,366 B2
(45) Date of Patent: Jun. 21, 2005

(54) METHOD OF USING A SOFT SUBPAD FOR CHEMICAL MECHANICAL POLISHING

(75) Inventor: John J. Gagliardi, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/339,963

(22) Filed: Jan. 10, 2003

(65) Prior Publication Data

US 2004/0137826 A1 Jul. 15, 2004

(51) Int. Cl.[7] ..... B24B 1/00
(52) U.S. Cl. ..... 451/41; 451/57
(58) Field of Search ..... 451/41, 57, 59, 451/285, 287, 288; 438/690, 692, 693

(56) References Cited

U.S. PATENT DOCUMENTS

| | | | | |
|---|---|---|---|---|
| 4,927,432 | A | 5/1990 | Budinger et al. | |
| 5,110,843 | A | 5/1992 | Bries et al. | |
| 5,152,917 | A | 10/1992 | Pieper et al. | |
| 5,514,245 | A * | 5/1996 | Doan et al. | 438/693 |
| 5,667,541 | A | 9/1997 | Klun et al. | |
| 5,692,950 | A | 12/1997 | Rutherford et al. | |
| 5,897,426 | A | 4/1999 | Somekh | |
| 5,913,712 | A * | 6/1999 | Molinar | 451/41 |
| 5,958,794 | A | 9/1999 | Bruxvoort et al. | |
| 5,968,843 | A | 10/1999 | Dawson et al. | |
| 6,007,407 | A | 12/1999 | Rutherford et al. | |
| 6,180,020 | B1 | 1/2001 | Moriyama et al. | |
| 6,194,317 | B1 | 2/2001 | Kaisaki et al. | |
| 6,231,629 | B1 | 5/2001 | Christianson et al. | |
| 6,234,875 | B1 | 5/2001 | Pendergrass, Jr. | |
| 6,383,066 | B1 | 5/2002 | Chen et al. | |
| 6,435,942 | B1 * | 8/2002 | Jin et al. | 451/8 |
| 6,461,226 | B1 * | 10/2002 | Yi | 451/41 |
| 6,620,725 | B1 * | 9/2003 | Shue et al. | 438/633 |
| 2001/0051500 | A1 | 12/2001 | Homma et al. | |
| 2002/0002028 | A1 | 1/2002 | Torii et al. | |
| 2002/0004365 | A1 | 1/2002 | Jeong et al. | |
| 2002/0039880 | A1 | 4/2002 | Torii et al. | |
| 2002/0151253 | A1 | 10/2002 | Kollodge et al. | |
| 2002/0177386 | A1 | 11/2002 | Smith | |
| 2002/0192962 | A1 | 12/2002 | Miyashita et al. | |

FOREIGN PATENT DOCUMENTS

| | | |
|---|---|---|
| EP | 0 874 390 A1 | 10/1998 |
| EP | 1 050 369 A2 | 11/2000 |
| EP | 1 077 108 A1 | 2/2001 |
| WO | WO 99/06182 | 2/1999 |
| WO | WO 01/53042 A1 | 7/2001 |
| WO | WO 02/062527 A1 | 8/2002 |
| WO | WO 02/074490 A1 | 9/2002 |

OTHER PUBLICATIONS

ASTM–2240–97, Standard Test Method for Rubber Property—Durometer Hardness, Mar. 1997.*
Volara® Type EO, Voltek Technical Data Sheet.

* cited by examiner

*Primary Examiner*—Dung Van Nguyen
(74) *Attorney, Agent, or Firm*—Colene H. Blank

(57) ABSTRACT

The present invention is directed to a method of modifying a wafer surface comprising providing a first abrasive article comprising a first three-dimensional fixed abrasive element and a first subpad generally coextensive with the first fixed abrasive element, contacting a surface of the first three-dimensional fixed abrasive element with a wafer surface, and relatively moving the first abrasive article and the wafer. The method additionally provides providing a second abrasive article comprising a second three-dimensional fixed abrasive element and a second subpad generally coextensive with the second fixed abrasive element, contacting a surface of the second three-dimensional fixed abrasive element with the wafer surface, and relatively moving the second abrasive article and the wafer. Wherein the first subpad has a deflection less than the deflection of the second subpad when measured 1.5 cm from the edge of a 1 kg weight, the weight having a contact area of 1.9 cm diameter.

13 Claims, 5 Drawing Sheets

METHOD OF USING A SOFT SUBPAD FOR CHEMICAL MECHANICAL POLISHING

FIELD

The present invention is directed to abrasive articles and methods of using said articles.

BACKGROUND

Semiconductor wafers have a semiconductor base. The semiconductor base can be made from any appropriate material such as single crystal silicon, gallium arsenide, and other semiconductor materials known in the art. Over a surface of the semiconductor base is a dielectric layer. This dielectric layer typically contains silicon dioxide, however, other suitable dielectric layers are also contemplated in the art.

Over the front surface of the dielectric layer are numerous discrete metal interconnects (e.g., metal conductor blocks). Each metal interconnect can be made, for example, from aluminum, copper, aluminum copper alloy, tungsten, and the like. These metal interconnects are typically made by first depositing a continuous layer of the metal on the dielectric layer. The metal is then etched and the excess metal removed to form the desired pattern of metal interconnects. Afterwards, an insulating layer is applied over top of each metal interconnect, between the metal interconnects and over the surface of the dielectric layer. The insulating layer is typically a metal oxide such as silicon dioxide, BPSG (borophosphosilicate glass), PSG (phosphosilicate glass), or combinations thereof. The resulting insulating layer often has a front surface that may not be as "planar" and/or "uniform" as desired.

Before any additional layers of circuitry can be applied via a photolithography process, it is desired to treat the front surface of the insulating layer to achieve a desired degree of "planarity" and/or "uniformity;" the particular degree will depend on many factors, including the individual wafer and the application for which it is intended, as well as the nature of any subsequent processing steps to which the wafer may be subjected. For the sake of simplicity, throughout the remainder of this application this process will be referred to as "planarization". As a result of planarization, the front surface of the insulating layer should be sufficiently planar such that when the subsequent photolithography process is used to create a new circuit design, the critical dimension features can be resolved. These critical dimension features form the circuitry design.

Other layers may also be planarized in the course of the wafer fabrication process. In fact, after each additional layer of insulating material is applied over the metal interconnects, planarization may be needed. The blank wafer may need to be planarized as well. Additionally, the wafer may include conductive layers, such as copper, that need planarization as well. A specific example of such a process is the metal Damascene processes.

In the Damascene process, a pattern is etched into an oxide dielectric (e.g., silicon dioxide) layer. After etching, optional adhesion/barrier layers are deposited over the entire surface. Typical barrier layers may comprise tantalum, tantalum nitride, titanium or titanium nitride, for example. Next, a metal (e.g., copper) is deposited over the dielectric and any adhesion/barrier layers. The deposited metal layer is then modified, refined or finished by removing the deposited metal and optionally portions of the adhesion/barrier layer from the surface of the dielectric. Typically, enough surface metal is removed so that the outer exposed surface of the wafer comprises both metal and an oxide dielectric material. A top view of the exposed wafer surface would reveal a planar surface with metal corresponding to the etched pattern and dielectric material adjacent to the metal. The metal(s) and oxide dielectric material(s) located on the modified surface of the wafer inherently have different physical characteristics, such as different hardness values. The abrasive treatment used to modify a wafer produced by the Damascene process must be designed to simultaneously modify the metal and dielectric materials without scratching the surface of either material. The abrasive treatment creates a planar outer exposed surface on a wafer having an exposed area of a metal and an exposed area of a dielectric material.

One conventional method of modifying or refining exposed surfaces of structured wafers treats a wafer surface with a slurry containing a plurality of loose abrasive particles dispersed in a liquid. Typically this slurry is applied to a polishing pad and the wafer surface is then ground or moved against the pad in order to remove material from the wafer surface. The slurry may also contain chemical agents or working liquids that react with the wafer surface to modify the removal rate. The above described process is commonly referred to as a chemical-mechanical planarization (CMP) process.

An alternative to CMP slurry methods uses an abrasive article to modify or refine a semiconductor surface and thereby eliminate the need for the foregoing slurries. The abrasive article generally includes a sub-pad construction. Examples of such abrasive articles can be found in U.S. Pat. Nos. 5,958,794; 6,194,317; 6,234,875; 5,692,950; and 6,007,407, which are incorporated by reference. The abrasive article has a textured abrasive surface which includes abrasive particles dispersed in a binder. In use, the abrasive article is contacted with a semiconductor wafer surface, often in the presence of a working liquid, with a motion adapted to modify a single layer of material on the wafer and provide a planar, uniform wafer surface. The working liquid is applied to the surface of the wafer to chemically modify or otherwise facilitate the removal of a material from the surface of the wafer under the action of the abrasive article.

The planarization process may be achieved in more than one step. It has been known to planarize a semiconductor wafer in two steps. Generally, it has been known to use a fixed abrasive article with a sub pad in a two step process. Such a fixed abrasive product is described, for example, in U.S. Pat. No. 5,692,950 (Rutherford, et al.), incorporated by reference.

SUMMARY

Use of a fixed abrasive article with a sub pad in wafer planarization can lead to some undesireable effects. For example, some wafers may experience uneven thickness across the wafer or within a die. The present application is directed to a new method of planarizing a wafer using fixed abrasive articles. This new method of using a fixed abrasive article results in better uniformity across the wafer while maintaining a desireable polish.

The present invention is directed to a method of modifying a wafer surface comprising providing a first abrasive article comprising a first three-dimensional fixed abrasive element and a first subpad generally coextensive with the first fixed abrasive element, contacting a surface of the first three-dimensional fixed abrasive element with a wafer surface, and relatively moving the first abrasive article and the wafer. The method additionally provides providing a second abrasive article comprising a second three-dimensional fixed abrasive element and a second subpad generally coextensive with the second fixed abrasive element, contacting a surface of the second three-dimensional fixed abrasive element with the wafer surface, and relatively moving the second abrasive article and the wafer. Wherein the first subpad has a deflection less than the deflection of the second subpad when measured 1.5 cm from the edge of a 1 kg weight, the weight having a contact area of 1.9 cm diameter.

Throughout this application, the following definitions apply:

"Surface modification" refers to wafer surface treatment processes, such as polishing and planarizing;

"Fixed abrasive element" refers to an abrasive article, that is substantially free of unattached abrasive particles except as may be generated during modification of the surface of the workpiece (e.g., planarization). Such a fixed abrasive element may or may not include discrete abrasive particles;

"Three-dimensional" when used to describe a fixed abrasive element refers to a fixed abrasive element, particularly a fixed abrasive article, having numerous abrasive particles extending throughout at least a portion of its thickness such that removing some of the particles at the surface during planarization exposes additional abrasive particles capable of performing the planarization function;

"Textured" when used to describe a fixed abrasive element refers to a fixed abrasive element, particularly a fixed abrasive article, having raised portions and recessed portions;

"Abrasive composite" refers to one of a plurality of shaped bodies which collectively provide a textured, three-dimensional abrasive element comprising abrasive particles and binder; and "Precisely shaped abrasive composite" refers to an abrasive composite having a molded shape that is the inverse of the mold cavity which is retained after the composite has been removed from the mold; preferably, the composite is substantially free of abrasive particles protruding beyond the exposed surfaces of the shape before the abrasive article has been used, as described in U.S. Pat. No. 5,152,917 (Pieper et al.).

DETAILED DESCRIPTION

Figure 1:
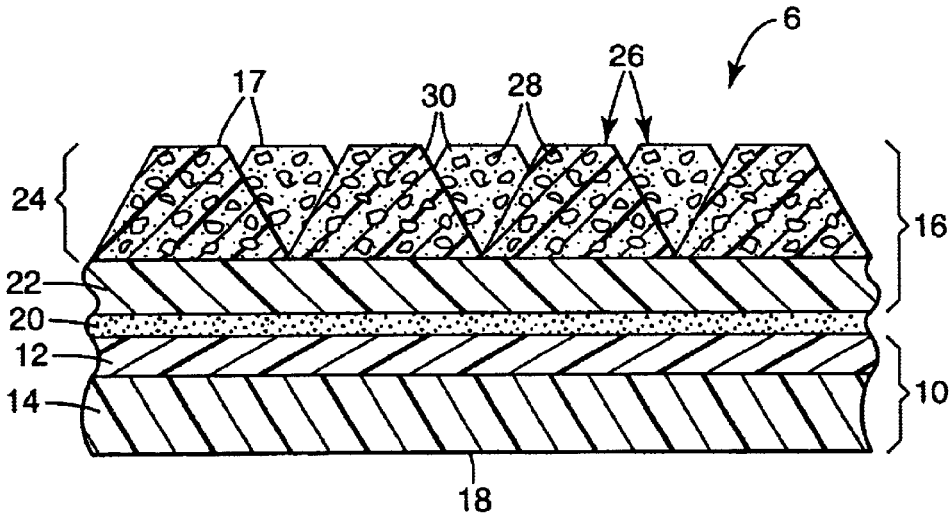
FIG. 1 is a cross sectional view of a portion of a fixed abrasive article such as those used in embodiments of the present invention.

The present invention is directed to a method of polishing a semiconductor wafer using a two step process. FIG. 1 is a cross sectional view of an example of one embodiment of a fixed abrasive article 6 used in the present process, including a subpad 10 and a fixed abrasive element 16. As shown in the embodiment of FIG. 1, subpad 10 includes at least one rigid element 12 and at least one resilient element 14, which is either attached or in contact with the fixed abrasive element 16. However, in certain embodiments, the subpad has only a resilient element 14 or a rigid element 12, or any combination of layers of resilient and rigid elements. In the embodiment shown in FIG. 1, the rigid element 12 is interposed between the resilient element 14 and the fixed abrasive element 16. The fixed abrasive element 16 has surfaces 17 that contact a workpiece, such as a semiconductor wafer. Thus, in the abrasive constructions used in the present invention, the rigid element 12 and the resilient element 14 are generally co-continuous with, and parallel to, the fixed abrasive element 16, such that the three elements are substantially coextensive. Although not shown in FIG. 1, surface 18 of the resilient element 14 is typically attached to a platen of a machine for semiconductor wafer modification, and surfaces 17 of the fixed abrasive element 16 contacts the semiconductor wafer.

As shown in FIG. 1, this embodiment of the fixed abrasive element 16 includes a backing 22 having a surface to which is bonded an abrasive coating 24, which includes a predetermined pattern of a plurality of precisely shaped abrasive composites 26 comprising abrasive particles 28 dispersed in a binder 30. However, as stated above, the fixed abrasive element, and therefore the abrasive layer, may be free of abrasive particles. In other embodiments, the fixed abrasive element is random, for example in textured fixed abrasive elements such as those sold under the tradename IC-1000 and IC-1010, (available from Rodel, Inc., Newark, Del.), and other conditioned fixed abrasive elements. Abrasive coating 24 may be continuous or discontinous on the backing. In certain embodiments, however, the fixed abrasive article does not require a backing.

Although FIG. 1 displays a textured, three-dimensional, fixed abrasive element having precisely shaped abrasive composites, the abrasive compositions of the present invention are not limited to precisely shaped composites. That is, other textured, three-dimensional, fixed abrasive elements are possible, such as those disclosed in U.S. Pat. No. 5,958,794, which is incorporated herein by reference.

There may be intervening layers of adhesive or other attachment means between the various components of the abrasive construction. For example, as shown in the embodiment of FIG. 1, an optional adhesive layer 20 is interposed between the rigid element 12 and the backing 22 of the fixed abrasive element 16, although a pressure sensitive adhesive layer is not necessary. Although not shown in FIG. 1, there may also be an adhesive layer interposed between the rigid element 12 and the resilient element 14, and on the surface 18 of the resilient element 14.

The method of the present invention is practiced in a dual step process. The first step uses a fixed abrasive article comprising a first subpad. The second step uses a fixed abrasive article comprising a second subpad.

The first subpad generally has a first resilient element. The first resilient element generally has a Shore A hardness (as measured using ASTM-D2240) of not greater than about 60. In other embodiments, the Shore A hardness is not greater than about 30, for example not greater than about 20. In some embodiments, the Shore A hardness of the first resilient element is not greater than about 10, and in certain embodiments, the first resilient element has a Shore A hardness of not greater than about 4. In some embodiments, the Shore A hardness of the first resilient element is greater than about 1, and in certain embodiments, the first resilient element has a Shore A hardness of greater than about 2.

The entire first subpad has a deflection measurement, which is measured 1.5 cm from the edge of a 1 kg weight, the weight having a contact area of 1.9 cm diameter. The lower the deflection, the more flexible the subpad. The first subpad has a deflection of no greater than 0.08 mm. In certain embodiments, the deflection of the first subpad is no greater than 0.04 mm. Generally the deflection of the first subpad is greater than 0.005 mm, for example greater than 0.01 mm.

The second sub pad has a higher deflection value that the first subpad. In some embodiments, the second subpad has a deflection value ten (10) times the deflection value of the first subpad.

Resilient materials for use in the abrasive constructions can be selected from a wide variety of materials. Typically, the resilient material is an organic polymer, which can be thermoplastic or thermoset and may or may not be inherently elastomeric. The materials generally found to be useful resilient materials are organic polymers that are foamed or blown to produce porous organic structures, which are typically referred to as foams. Such foams may be prepared from natural or synthetic rubber or other thermoplastic elastomers such as polyolefins, polyesters, polyamides, polyurethanes, and copolymers thereof, for example. Suitable synthetic thermoplastic elastomers include, but are not limited to, chloroprene rubbers, ethylene/propylene rubbers, butyl rubbers, polybutadienes, polyisoprenes, EPDM polymers, polyvinyl chlorides, polychloroprenes, or styrene/butadiene copolymers. A particular example of a useful resilient material is a copolymer of polyethylene and ethyl vinyl acetate in the form of a foam.

Resilient materials may also be of other constructions if the appropriate mechanical properties (e.g., Young's Modulus and remaining stress in compression) are attained. Polyurethane impregnated felt-based materials such as are used in conventional polishing pads can be used, for example. The resilient material may also be a nonwoven or woven fiber mat of, for example, polyolefin, polyester, or polyamide fibers, which has been impregnated by a resin (e.g. polyurethane). The fibers may be of finite length (i.e., staple) or substantially continuous in the fiber mat.

Specific resilient materials that are useful in the abrasive constructions of the present invention include, but are not limited to Voltek Volara 2EO and Voltek 12EO White foam (available from Voltek, a division of Sekisui America Corp., of Lawrence, Mass.).

As disclosed above and shown in FIG. 1, the fixed abrasive article subpad may also include a rigid element. Rigid materials for use in the abrasive constructions can be selected from a wide variety of materials, such as organic polymers, inorganic polymers, ceramics, metals, composites of organic polymers, and combinations thereof. Suitable organic polymers can be thermoplastic or thermoset. Suitable thermoplastic materials include, but are not limited to, (meth)acrylic), polycarbonates, polyesters, polyurethanes, polystyrenes, polyolefins, polyperfluoroolefins, polyvinyl chlorides, and copolymers thereof. Suitable thermosetting polymers include, but are not limited to, epoxies, polyimides, polyesters, and copolymers thereof. As used herein, copolymers include polymers containing two or more different monomers (e.g., terpolymers, tetrapolyrners, etc.).

The organic polymers may or may not be reinforced. The reinforcement can be in the form of fibers or particulate material. Suitable materials for use as reinforcement include, but are not limited to, organic or inorganic fibers (continuous or staple), silicates such as mica or talc, silica-based materials such as sand and quartz, metal particulates, glass, metallic oxides, and calcium carbonate.

Metal sheets can also be used as the rigid element. Typically, because metals have a relatively high Young's Modulus (e.g., greater than about 50 GPa), very thin sheets are used (typically about 0.075–0.25 mm). Suitable metals include, but are not limited to, aluminum, stainless steel, and copper.

Specific materials that are useful in the abrasive constructions of the present invention include, but are not limited to, (meth)acrylic, polyethylene, poly(ethylene terephthalate) and polycarbonate.

The method of the present invention can use many types of machines for planarizing semiconductor wafers, as are well known in the art for use with polishing pads and loose abrasive slurries. An example of a suitable commercially available machine is sold under the tradename REFLEXION WEB polisher (from Applied Materials of Santa Clara, Calif.)

Typically, such machines include a head unit with a wafer holder, which may consist of both a retaining ring and a wafer support pad for holding the semiconductor wafer. Typically, both the semiconductor wafer and the abrasive construction rotate, preferably in the same direction. The wafer holder rotates either in a circular fashion, spiral fashion, elliptical fashion, a nonuniform manner, or a random motion fashion. The speed at which the wafer holder rotates will depend on the particular apparatus, planarization conditions, abrasive article, and the desired planarization criteria. In general, however, the wafer holder rotates at a rate of about 2–1000 revolutions per minute (rpm).

The abrasive article of the present invention will typically have a working area of about 325–12,700 $cm^2$, preferably about 730–8100 $cm^2$, more preferably about 1140–6200 $cm^2$. It may rotate as well, typically at a rate of about 5–10,000 rpm, preferably at a rate of about 10–1000 rpm, and more preferably about 10–100 rpm. Surface modification procedures which utilize the abrasive constructions of the present inventions typically involve pressures of about 6.9–70 kPa.

Generally, the process will be performed in the presence of a working liquid. Such a working liquid may contain abrasive particle or may be free of abrasive particle. Suitable working liquids are described in U.S. Pat. No. 6,194,317 and in U.S. Application Publication Number 2002/0151253, which are incorporated herein by reference.

Various modifications and alterations of this invention will become apparent to those skilled in the art without departing from the scope and spirit of this invention, and it should be understood that this invention is not to be unduly limited to the illustrative embodiments set forth herein.

EXAMPLES

Polishing Procedure

A 200 mm diameter, 0. 17 $\mu$m DRAM STI (HDP coated, 3500 Å step, 200 Å overburden) wafer was polished in a two step process on an Obsidian 501 polisher (Applied Materials, Santa Clara, Calif.)

| Polishing Conditions: | 1st Step | |
|---|---|---|
| | Wafer Pressure | 2.0 psi (13.8 kPa) |
| | Ring Pressure | 2.5 psi (17.2 kPa) |
| | Velocity | 600 mm/sec |
| | Chemistry | DI water adjusted to pH = 11.2 with KOH |
| | Polishing time | 90 sec |
| | Web Increment | 0.25 in (0.635 cm) |

-continued

| 2nd Step | |
|---|---|
| Wafer Pressure | 3.0 psi (20.7 kPa) |
| Ring Pressure | 3.0 psi (20.7 kPa) |
| Velocity | 600 mm/sec |
| Chemistry | 2.5% L-Proline solution at a pH of 10.5 with KOH |
| Polishing time | 90 sec |
| Web Increment | 0.25 in (0.635 cm) |

Example 1

A polished control was polished with a SWR159-R2 (available from 3M Company, St. Paul, Minn.) using a subpad with a polycarbonate layer(8010MC Lexan Polycarbonate sheet from GE Polymershapes of Huntersville, N.C.) having a thickness of 0.060 in (1.52 mm) and a foam layer was 0.090 in (2.3 mm) Voltek 12EO White. The subpad was attached to the platen of the Obsidian 501. Polishing was terminated after a target of 100 Ångstroms of nitride was removed from the surface of the wafer using the polishing step designed for Step 2 above, with the exception that the polishing time was 150 seconds. The polished control had residual active oxide over the nitride at the wafer edge. The active area oxide on the wafer is shown in Table 1.

TABLE 1

| | Unpolished Control Oxide | Polished Control Oxide |
|---|---|---|
| Average | 3761 | 115 |
| Range | 16 | 96 |
| Average Support | 3757 | 88 |
| Range Support | 8 | 56 |
| Average Array | 3763 | 130 |
| Range Array | 11 | 68 |

Wafers 1 and 2 were polished according to Step 1 of the Polishing Procedure using SWR159-R2 abrasive (available from 3M, St. Paul, Minn.) attached to a subpad construction of 0.007 in (0.18 mm) polycarbonate (8010MC Lexan Polycarbonate sheet from GE Polymershapes of Huntersville, N.C.) using 442 DL transfer adhesive also available from 3M of St. Paul, Minn. The opposite face of the polycarbonate sheet was laminated, using the same transfer adhesive, to a 0.125 in (3.175 mm) layer of Voltek Volara 2EO White foam (Voltek, a division of Sekisui America Corp., of Lawrence, Mass.) which, in turn, was attached to the platen of the Obsidian 501. Polishing was terminated after a target of 3400 Ångstroms of active oxide removed from the surface of the wafer.

Figure 2:
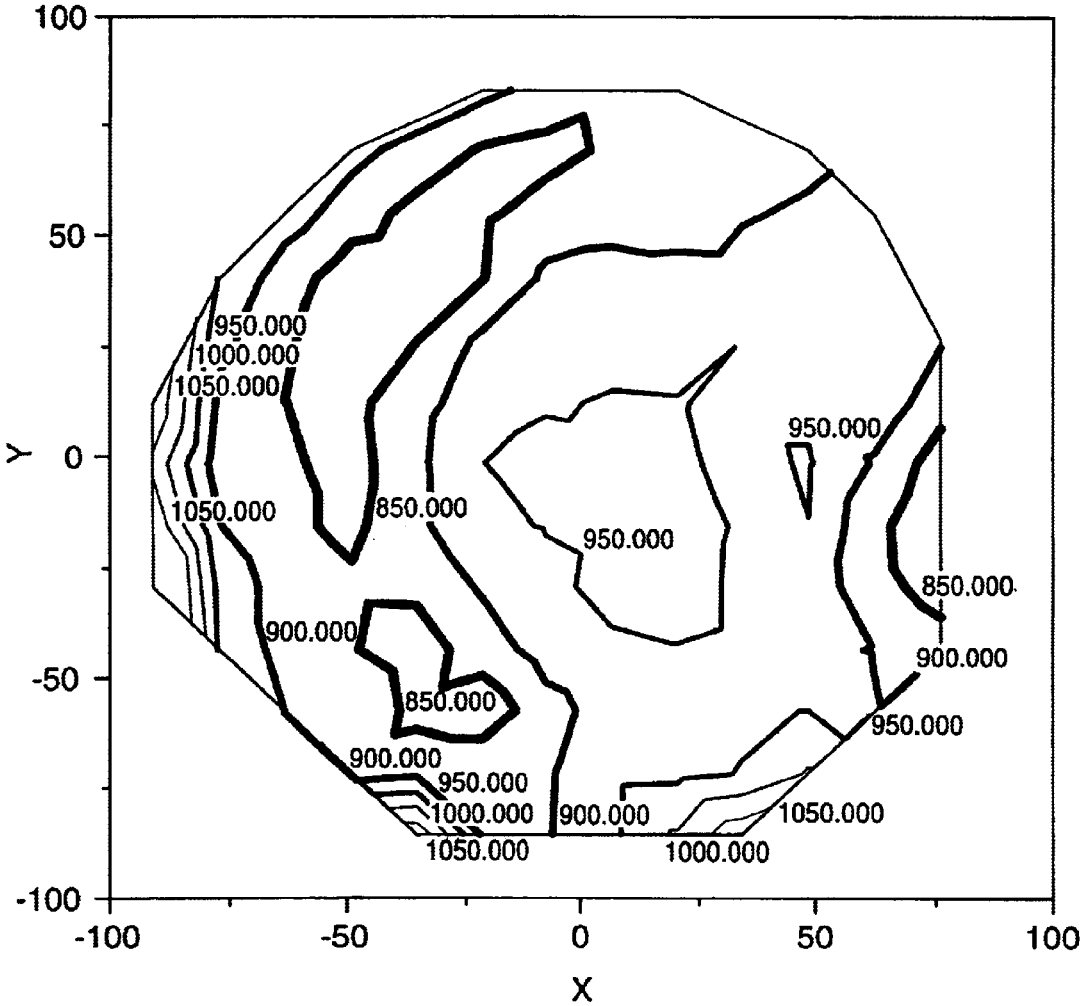
FIG. 2 is a contour plot showing values of remaining nitride films thickness on polished control example.
Figure 3:
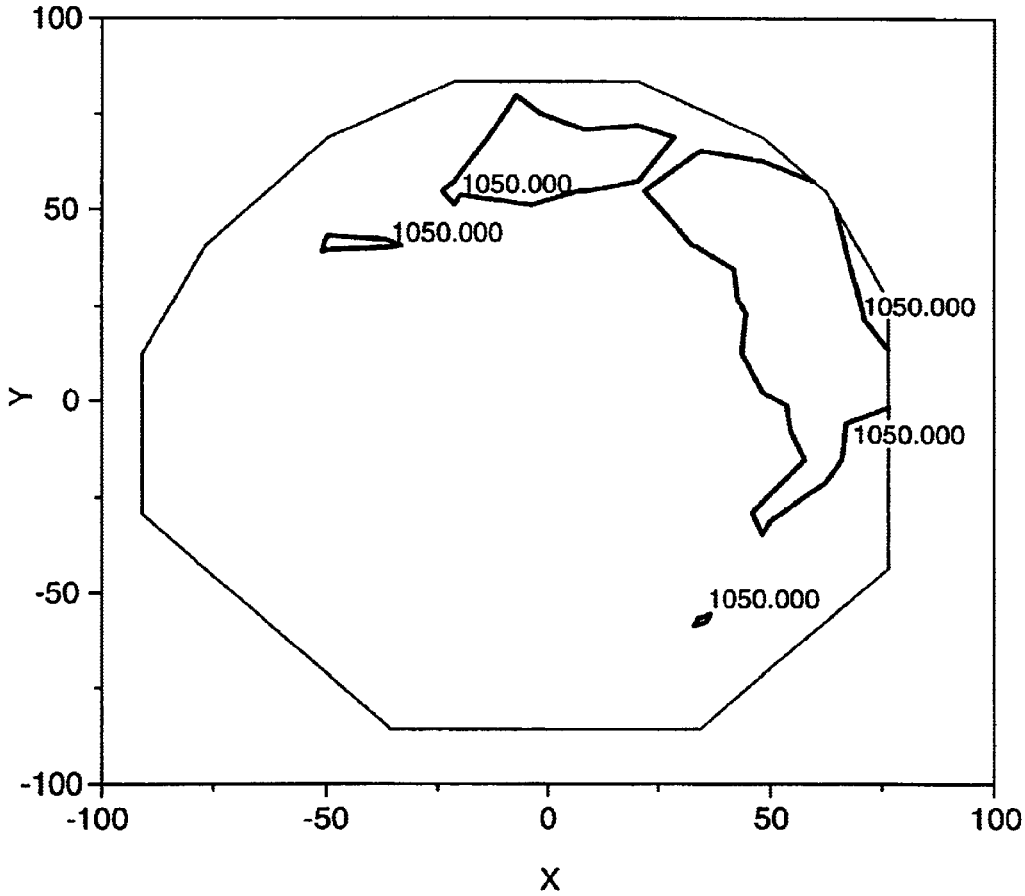
FIG. 3 is a contour plot showing values of remaining nitride films thickness on Wafer 1 after step 2.
Figure 4:
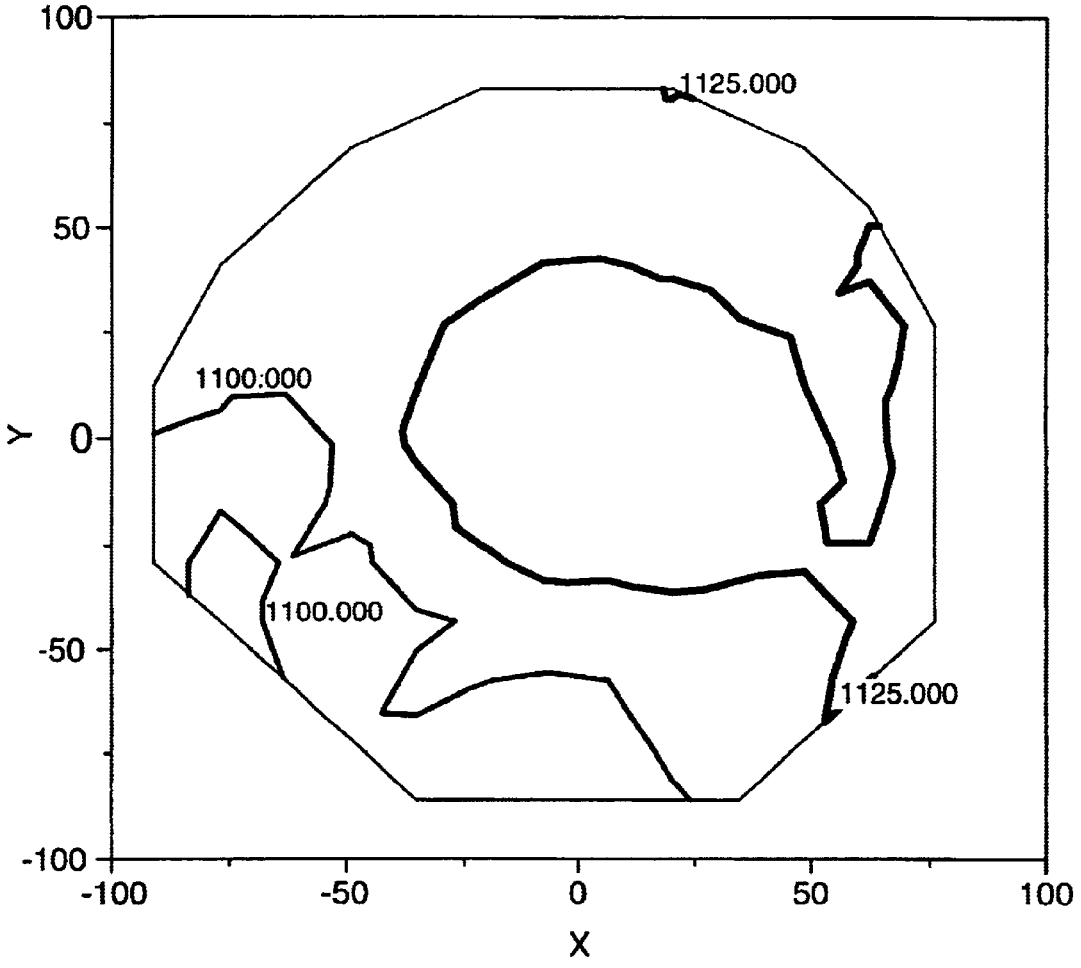
FIG. 4 is a contour plot showing values of remaining nitride films thickness on Wafer 2 after step 2.

Wafers 1 and 2 were then polished in a second step using an SWR521-125/10 abrasive (available from 3M) using a subpad similar to that used in Step 1 except that the polycarbonate layer of the subpad was 0.060 in (1.52 mm) thick polycarbonate and the foam layer was 0.090 in (2.3 mm) Voltek 12EO White. Within Die (WID) measurements were made in one die at ½ the wafer radius. Twenty-five locations (9 in the support area and 15 across an array) were measured within this die. The wafer characteristics, including the active area oxide and nitride film thickness are summarized in Tables 2 and 3. Within Wafer (WIW) nonuniformities were measured at in the main support area of each of 133 dies on the wafer. The results are presented as contour plots in FIG. 2 to 4.

TABLE 2

| Within Die (WID) Remaining Active Oxide and Nitride (Å) | | | | | | | | |
|---|---|---|---|---|---|---|---|---|
| | Step 1 | | | | Step 2 | | | |
| | Wafer 1 | | Wafer 2 | | Wafer 1 | | Wafer 2 | |
| | Oxide | Nitride | Oxide | Nitride | Oxide | Nitride | Oxide | Nitride |
| Average | 111 | 987 | 320 | 997 | 0 | 988 | 0 | 1001 |
| Range | 315 | 122 | 402 | 101 | 0 | 54 | 0 | 46 |
| Average Support | 42 | 1021 | 252 | 1017 | 0 | 999 | 0 | 1005 |
| Range Support | 230 | 15 | 402 | 36 | 0 | 35 | 0 | 45 |
| Average Array | 188 | 948 | 358 | 955 | 0 | 983 | 0 | 999 |
| Range Array | 183 | 62 | 171 | 39 | 0 | 37 | 0 | 25 |

TABLE 3

| Remaining Nitride At Wafer Edge (Å) | | | | | |
|---|---|---|---|---|---|
| | | Step 1 | | Step 2 | |
| | Unpolished Initial Nitride | Wafer 1 Remaining Nitride | Wafer 2 Remaining Nitride | Wafer 1 Remaining Nitride | Wafer 2 Remaining Nitride |
| Average | 1034 | 985 | 989 | 1000 | 1038 |
| Range | 39 | 127 | 161 | 113 | 77 |

Example 2

Figure 5:
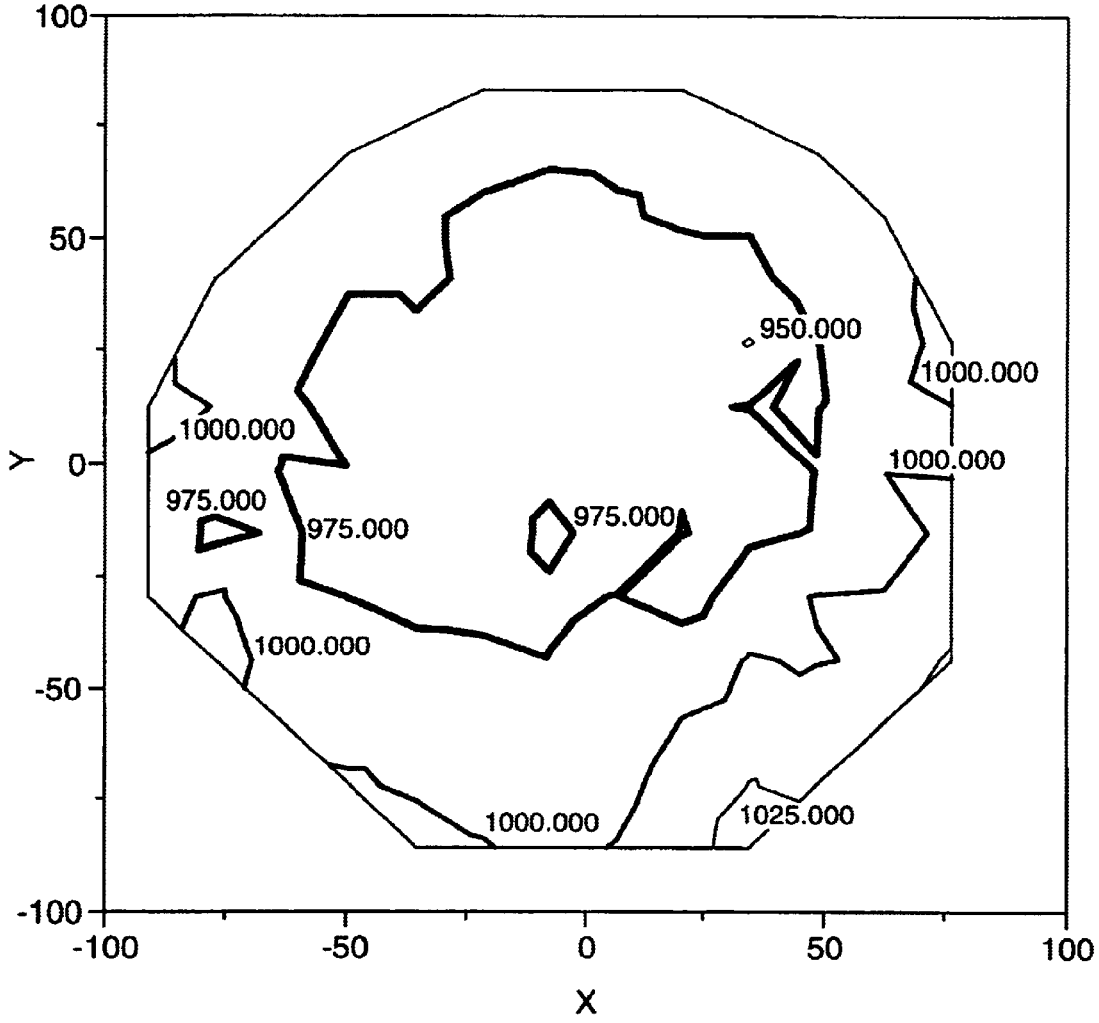
FIG. 5 is a contour plot showing values of remaining nitride films thickness on Example 2 after step 2.

Example 1 was repeated except that the 2.5% L-Proline solution adjusted to a pH of 10.5 with KOH was replaced by deionized water adjusted to a pH of 11.2. L-proline is believed to enhance the selectivity of removal to provide a rate stop when the nitride is exposed while enhancing the polishing rate of the oxide. The two step process maintained acceptable control of within die uniformity (WID) without resorting to selective chemistry. The within wafer (WIW) nonuniformity is shown in FIG. 5.

TABLE 4

| Within Die (WID) Remaining Active Oxide and Nitride (Å) Without L-Proline | | |
|---|---|---|
| | Example 2 Step 2 | |
| | Oxide | Nitride |
| Average | 0 | 928 |
| Range | 0 | 94 |
| Average Support | 0 | 955 |
| Range Support | 0 | 44 |
| Average Array | 0 | 911 |
| Range Array | 0 | 60 |

Subpad Deflection Under Static Local Load

The test was carried out by placing a 1 kg weight on a contact area of 1.9 cm diameter.

The deflection was measured 1.5 cm from the edge of the weight.

Pad 1 was the subpad used in Step 1 above.

Pad 2 was the subpad used in Step 2 above.

Pad 3 was the subpad of Step 2, with the exception that the polycarbonate layer was 0.020 inches (0.51 mm).

| Pad | Deflection (mm) |
|---|---|
| 1 | .013 |
| 2 | .13 |
| 3 | .085 |

What is claimed is:

1. A method of modifying a wafer surface comprising providing a first abrasive article comprising a first three-dimensional fixed abrasive element and a first subpad generally coextensive with the first fixed abrasive element;

contacting a surface of the first three-dimensional fixed abrasive element with a wafer surface;

relatively moving the first abrasive article and the wafer;

providing a second abrasive article comprising a second three-dimensional fixed abrasive element and a second subpad generally coextensive with the second fixed abrasive element;

contacting a surface of the second three-dimensional fixed abrasive element with the wafer surface;

relatively moving the second abrasive article and the wafer;

wherein the first subpad has a deflection less than the deflection of the second subpad when measured 1.5 cm from the edge of a 1 kg weight, the weight having a contact area of 1.9 cm diameter.

2. The method of claim 1 wherein the first subpad has a first resilient element, the first resilient element having a Shore A hardness of less than 60, when tested according to ASTM-2240-97.

3. The method of claim 2 wherein the first resilient element has a Shore A hardness not greater than 30.

4. The method of claim 2 wherein the first resilient element has a Shore A hardness not greater than 20.

5. The method of claim 2 wherein the first resilient element has a Shore A hardness not greater than 10.

6. The method of claim 2 wherein the first resilient element has a Shore A hardness not greater than 4.

7. The method of claim 2 wherein the first resilient element has a Shore A hardness greater than 2.

8. The method of claim 2 wherein the first resilient element has a Shore A hardness greater than 1.

9. The method of claim 2 wherein the first subpad has a first rigid element between the fixed abrasive element and the resilient element.

10. The method of claim 9 wherein the first rigid element has a thickness of about 0.18 mm.

11. The method of claim 1 wherein the deflection of the second subpad is ten times the deflection of the first subpad.

12. The method of claim 1 wherein the second subpad has a rigid element.

13. The method of claim 12 wherein the resilient element in the second subpad has a thickness of about 1.52 mm.

* * * * *

UNITED STATES PATENT AND TRADEMARK OFFICE

CERTIFICATE OF CORRECTION

PATENT NO. : 6,908,366 B2
DATED : June 21, 2005
INVENTOR(S) : Gagliardi, John J.

It is certified that error appears in the above-identified patent and that said Letters Patent is hereby corrected as shown below:

Column 5,
Line 57, delete “tetrapolyrners” and insert -- tetrapolymers --.

Column 6,
Line 43, after “Number” insert -- US --.

Signed and Sealed this

Twenty-first Day of March, 2006

JON W. DUDAS
*Director of the United States Patent and Trademark Office*